US005961270A

United States Patent [19]

Ortega et al.

[11] Patent Number: 5,961,270

[45] Date of Patent: Oct. 5, 1999

[54] APPARATUS FOR STORAGE OF VEHICLES

[76] Inventors: Hector M. Ortega; Hector S. Ortega, both of 301 Sharar Ave. Apt. 5, Opalocka, Fla. 33054

[21] Appl. No.: 08/934,257

[22] Filed: Sep. 19, 1997

[51] Int. Cl.[6] ..... E04H 6/12

[52] U.S. Cl. ..... 414/234; 414/239

[58] Field of Search ..... 414/234, 239, 414/240, 253, 259, 260

[56] References Cited

U.S. PATENT DOCUMENTS

| | | | |
|---|---|---|---|
| 2,412,009 | 12/1946 | Rickland | 414/239 |
| 5,314,284 | 5/1994 | Tsai | 414/234 |
| 5,333,987 | 8/1994 | Takaoka | 414/260 X |
| 5,374,150 | 12/1994 | Becker et al. | 414/254 |

FOREIGN PATENT DOCUMENTS

| | | | |
|---|---|---|---|
| 207573 | 8/1989 | Japan | 414/234 |
| 219261 | 9/1989 | Japan | 414/234 |
| 3096579 | 4/1991 | Japan | 414/240 |
| 4254673 | 9/1992 | Japan | 414/234 |
| 4285274 | 10/1992 | Japan | 414/234 |
| 4343981 | 11/1992 | Japan | 414/234 |

*Primary Examiner*—James W. Keenan
*Attorney, Agent, or Firm*—J. Sanchelima

[57] ABSTRACT

An apparatus for storing vehicles in a multi-level structure defining several spaces, each one with an entrance. The vehicles are driven to a platform mounted on the upper level of an entrance supporting assembly. The platform is engaged to a carrier assembly with a longitudinal traction mechanism that brings the platform to its upper level while within platform is passed from the lower level of the carrier assembly to the lower level of the entrance supporting platform. The carrier assembly brings the vehicle, mounted on the platform housed with its upper level, in alignment with an entrance of a parking space wherein a similar procedure takes place. The vehicle and the platform with upper level is delivered to the upper level of the parking space while, simultaneously, the lower platform is retrieved and housed within the lower level of the carrier assembly ready for the next car. In the meantime, the platform that was in the lower level of the entrance supporting assembly was brought to its upper level, ready to receive another vehicle.

5 Claims, 7 Drawing Sheets

APPARATUS FOR STORAGE OF VEHICLES

BACKGROUND OF THE INVENTION

1. Field of the Invention.

The present invention relates to apparatus for storage of vehicles.

2. Description of the Related Art.

Applicant believes that the closest reference corresponds to U.S. Pat. No. 5,374,150 issued to Becker et al. for a Multi-tier Parking Facility System for Depositing and Removing Vehicles. However, it differs from the present invention because it requires for each level one parking device and also a tier conveyor for vertically moving between drive in - and drive -out areas. Furthermore, the tier conveyor requires the use of a transfer device and a handling device. The patented invention is considerably more complicated especially as the number of levels increase. In contrast, the present invention only requires the use of one relatively simple platform assembly for each additional parking space.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a storage device or storage apparatus for vehicles that is volumetrically efficient and utilizes a minimum of real estate space.

It is another object of this invention to provide such a device that requires minimum operations and equipment in performing it's function.

It is still another object of the present invention to provide a device that protects a user from exposure to dangerous conditions since she/he does not operates the vehicle in remote or secluded parking spaces.

It is yet another object of this invention to provide such a device that is relatively inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 is a top view of one of the building structures wherein the present invention is installed, showing six parking spaces in two groups of three adjacent parking spaces on each floor divided by three utility spaces in between.

DETAILED DESCRIPTION OF THE PREFERRED EMBODIMENT

Figure 1:
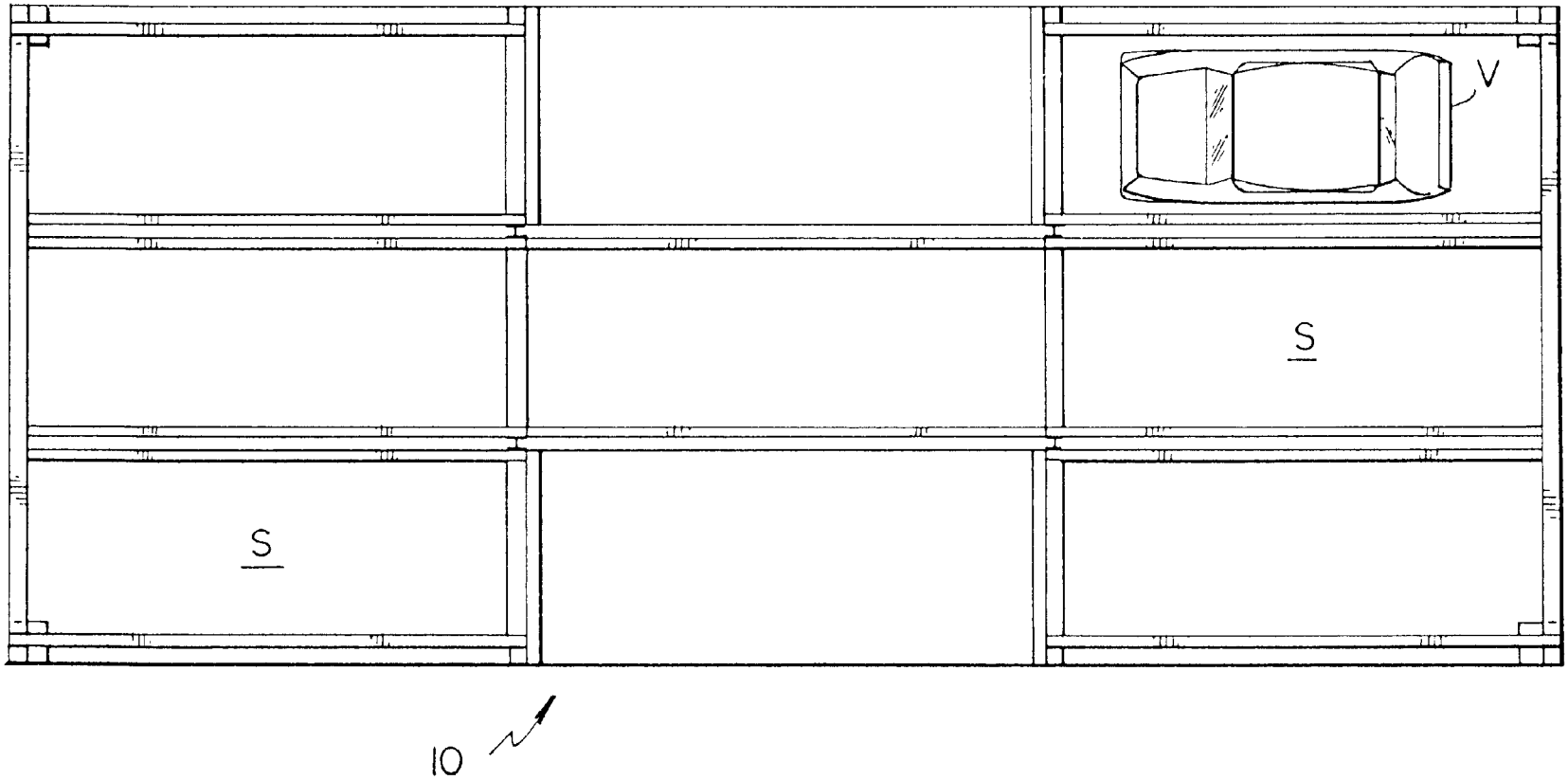

Referring now to the drawings, where the present invention is generally referred to with numeral 10, it can be observed that it basically includes an apparatus for storing vehicles in a structure with vertical and horizontal structural members 12 and 14 that form a building structure having a rectangular floor plan, as shown in FIG. 1. The building structure may include six (or more) parking spaces S, as shown in FIG. 1 for illustration purposes, per level and disposed in two groups of three adjacent parking spaces. The present invention comprises a plurality of assemblies, that in cooperative combination and functional synchronism, transport and store vehicles in a building structure 16 with maximum volumetric efficiency. Furthermore, after loading vehicle V on moving platform assembly 20, it does not require the operation of the vehicle. Also, vehicle V stays on the assigned platform assembly 20 during all the time that vehicle V is within apparatus 10. This characteristic has inherent benefits since each platform assembly 20 can be uniquely identified as well as each of the parking spaces. With the proper electronic coding equipment, the location of platform assemblies 20 can be readily ascertain. A computer assembly with memory is used to keep track of assemblies 20 and their storage location.

Figure 2:
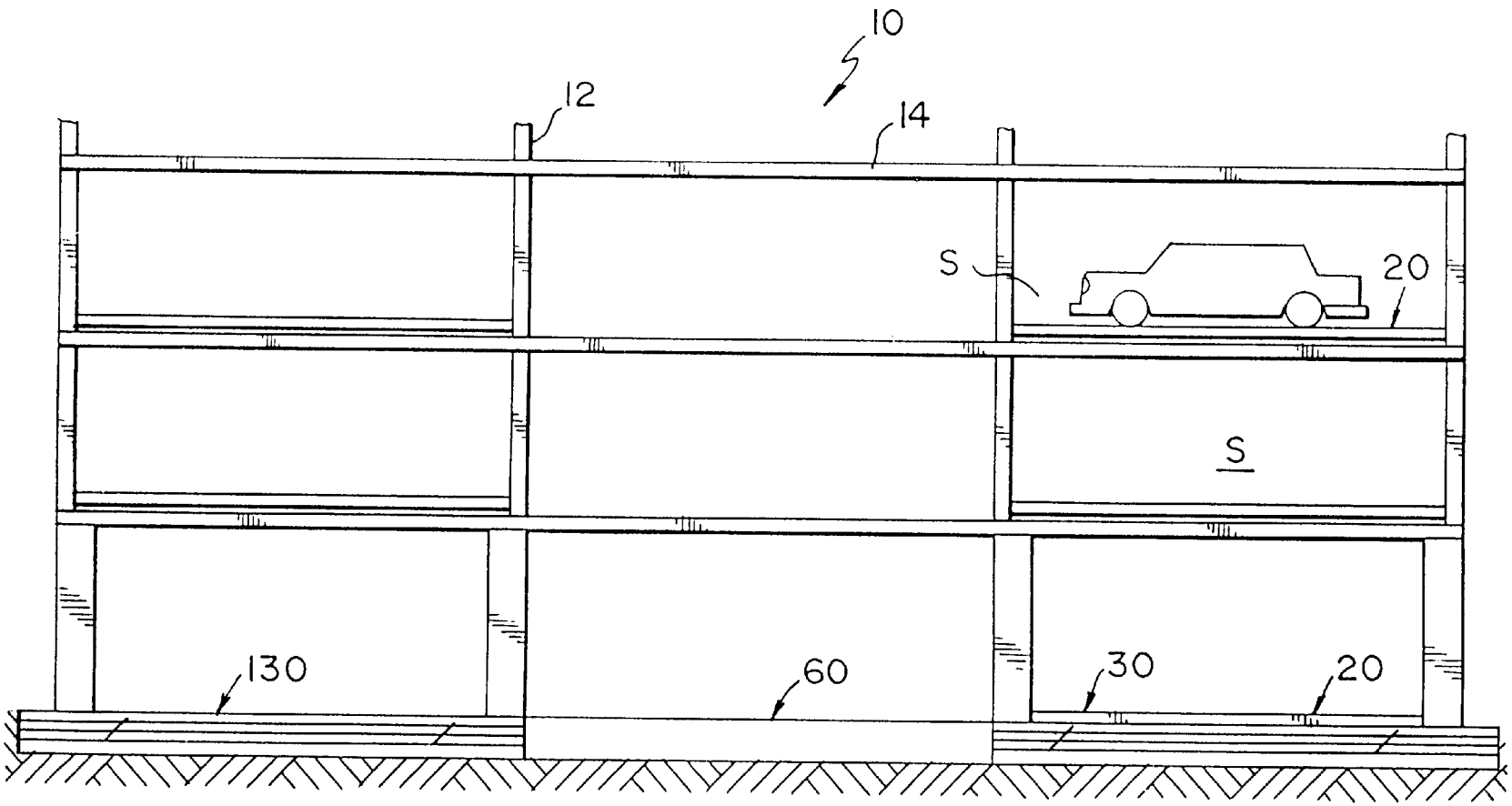
FIG. 2 is an elevational side view of the building structure shown in FIG. 1.
Figure 9:
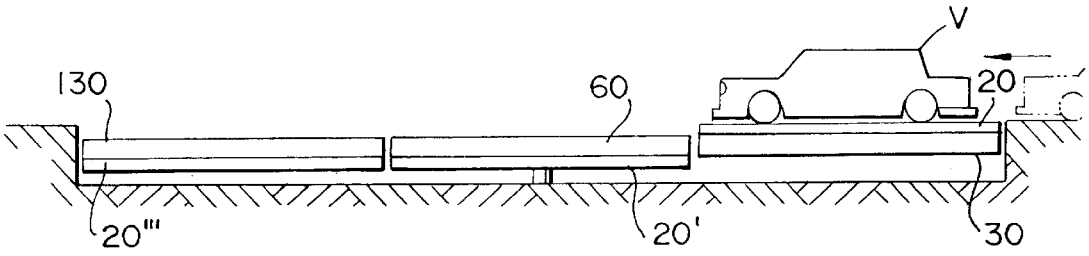
FIG. 9 is a representation of an application of the present invention showing the first step thereof, wherein a vehicle has been driven to a moving platform assembly on the entrance vehicle supporting assembly illustrated in FIGS. 3A and 4A.
Figure 13:
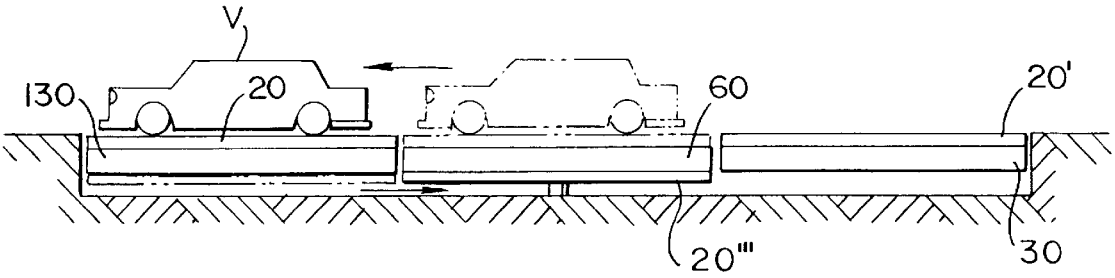
FIG. 13 is a representation of the step wherein the moving platform assembly carrying the vehicle is transported from the lifting assembly to the exit vehicle supporting assembly.

Apparatus 10, as shown in FIG. 2, basically has entrance and exit vehicle supporting assemblies 30 and 130 to support moving platform assemblies 20; 20'; 20" and 20''', and carrier assembly 60 to lift and lower vehicles. Vehicle supporting assemblies 30 and 130 are located in the entrance and exit areas, respectively, on the ground level of building structure 16. Supporting assembly 30 supports moving platform assembly 20 that receives incoming vehicles to be stored in parking spaces S of building structure 16 and supporting assembly 130 receives outgoing moving platform assembly 20 supporting vehicle V, as illustrated in FIGS. 9 and 13.

Figure 6:
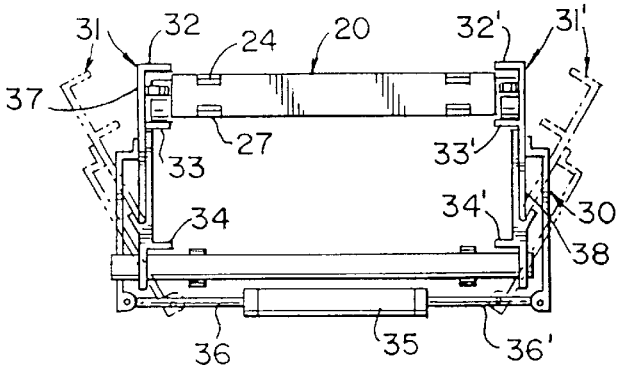
FIG. 6 is an elevational front view of the vehicle supporting assembly shown in FIG. 3A.
Figure 5:
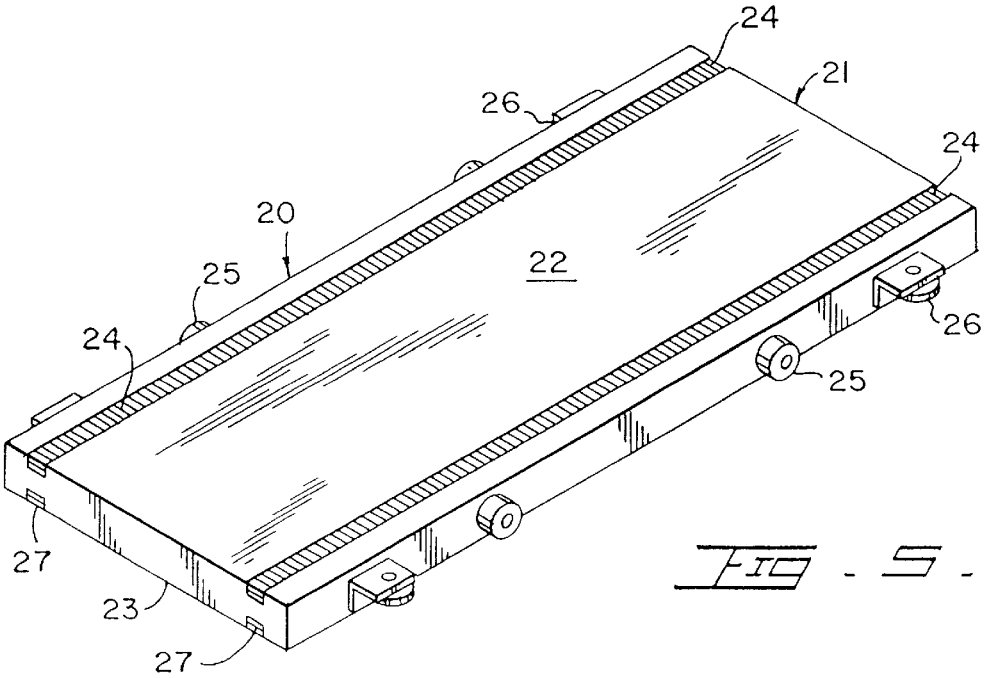
FIG. 5 is an isometric view from the top of a moving platform assembly used to transport the vehicles.

Moving platform assemblies 20; 20'; 20" and 20'", in the preferred embodiment, are designed to receive/load vehicles which rest on flat bed 21. As shown in FIG. 5, moving platform assembly 20 has upper surface 22 that in turn includes rack rails 24 mounted thereon. Similarly, lower surface 23 is provided with rack rails 27. When moving platform assembly 20 is on entrance supporting assembly 30, it is held in place by guiding assemblies 31 and 31' of supporting assembly 30, as best seen in FIG. 6. Guiding assemblies 31 and 31' include upper flanges 32 and 32' and middle flanges 33 and 33', respectively, which sandwich moving platform assembly 20 thereinbetween. Moving platform assembly 20 also includes rollers 25 mounted on both sides thereof to permit assembly 20 to slide along flanges 32; 32'; 33 and 33'. Spacer roller members 26 are designed to keep moving platform assembly 20 from coming in contact with inner lateral walls of guiding assemblies 31 and 31'.

Supporting assemblies 30 and 130, in the preferred embodiment, include lower and upper levels that receive moving platform assemblies 20; 20'; 20" and 20'". As best seen in FIG. 6, upper level 37 is provided with middle flanges 33 and 33', that provide support for rollers 25. And, the lower level 38 includes lower flanges 34 and 34' that provide support for platform assembly 20', as shown in FIG. 6. One of those levels always will be empty when the other one is loaded with moving platform assemblies 20 or 20'.

Figure 7:
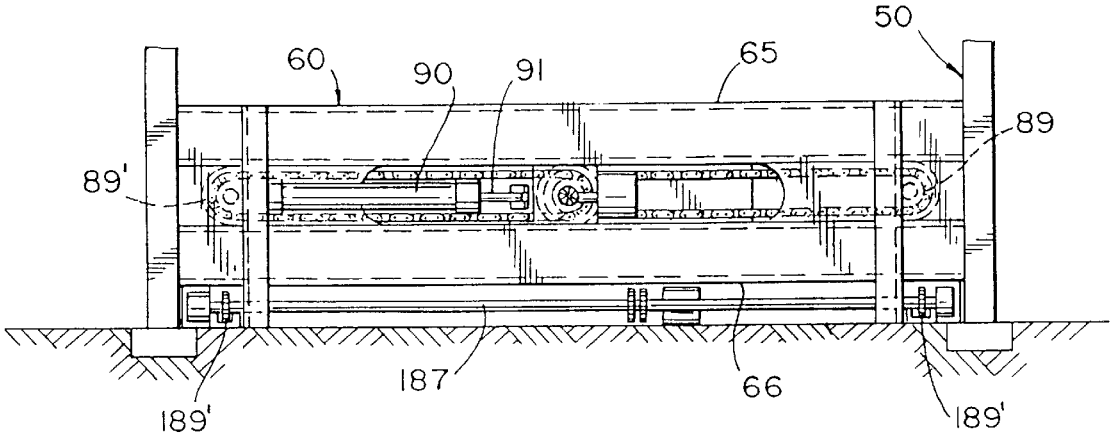
FIG. 7 is an elevational side view of the carrier assembly 60 with moving platform assemblies 20 and 20' in phantom.
Figure 8:
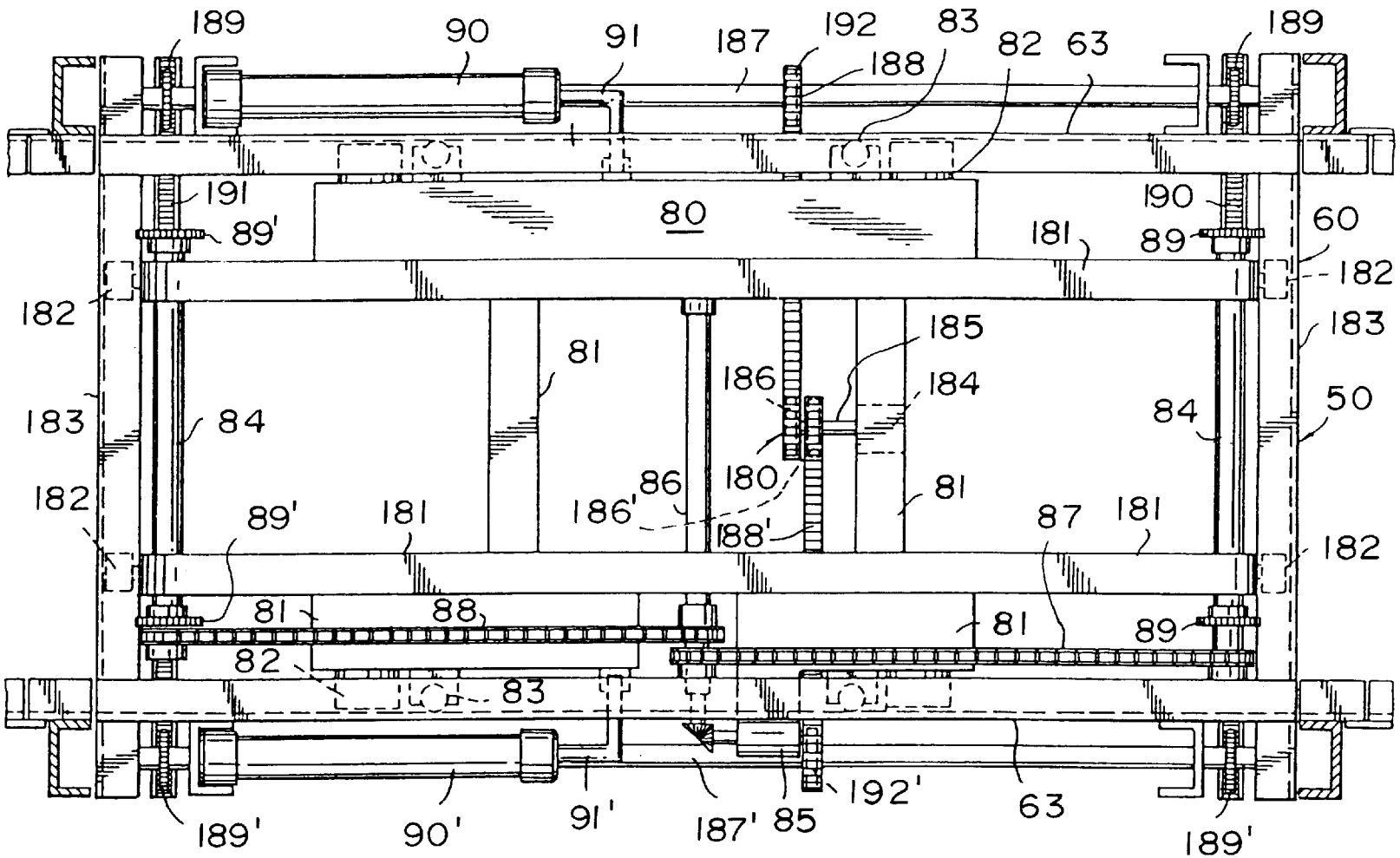
FIG. 8 is a top view of the vehicle supporting assembly shown in FIG. 7.

Carrier assembly 60, in the preferred embodiment, is mounted on lifting assembly 50 which is positioned between supporting assemblies 30 and 130, as illustrated in FIGS. 2 and 8. Carrier assembly 60 and supporting assemblies 30 and 130 are located next to each other forming a longitudinal track for horizontally transporting vehicles at the ground level. Carrier assembly 60, as shown in FIG. 7, also has upper level 65 and lower level 66 to receive and release, at the same time, moving platform assemblies 20 and 20'. As described above for supporting assembly 30, one of levels 65 and 66 always will be empty and the other one loaded with one of moving platform assemblies 20 or 20'. In this manner, when upper level 37 of assembly 30 is loaded, upper level 65 is empty, and viceversa.

Carrier assembly 60, includes longitudinal traction assembly 80 and lateral traction assembly 180. Once traction assembly 80 is activated, assembly 60 is longitudinally urged towards moving platform assembly 20. Assembly 20 is loaded with a vehicle and is pulled towards carrier assembly 60. Lower level 38 is emptied and upper level 37 receives loaded moving platform assembly 20. Traction assembly 80 includes piston cylinder assemblies 90 and 90' that actuate arms 91 and 91, respectively, that in turn are rigidly mounted to frame 81 of traction assembly 80. Longitudinal traction assembly 80 basically includes frame 81 with lateral rollers 82 and spacer roller members 83 that permit traction assembly 80 to slide along guiding rails 63. Hydraulic arms 91 and 91' are actuated, carrier assembly is slightly displaced longitudinally. These hydraulic arms are needed to bring assembly 50 closer to assemblies 20 and 20' and permit the meshed engagement to begin. Longitudinal traction assembly 80 includes also motor 85 that moves sprocket chains 87 and 88 through shaft 86. Sprocket chains 87 and 88 cause shaft 84 to rotate and thus sprockets 89 also rotate. Once frame 81 brought towards moving platform assembly 20, sprocket members 89 cooperatively engage with lower rack rails 27 thereby pulling moving platform assembly 20 with incoming vehicle V on it towards assembly 60. At the same time, unloaded moving platform assembly 20' (by the rotational motion of sprocket members 89' and their subsequent engagement with upper rack 24) is transported to lower lever 48 of entrance vehicle supporting assembly 30.

Figure 4A:
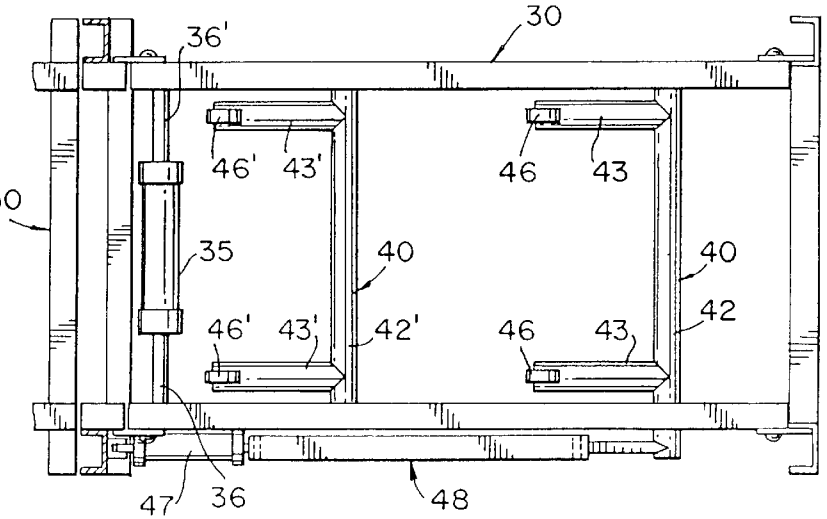
FIG. 4A is a top view of the mechanism shown in FIG. 3A illustrating the vehicle supporting assembly.
Figure 3A:
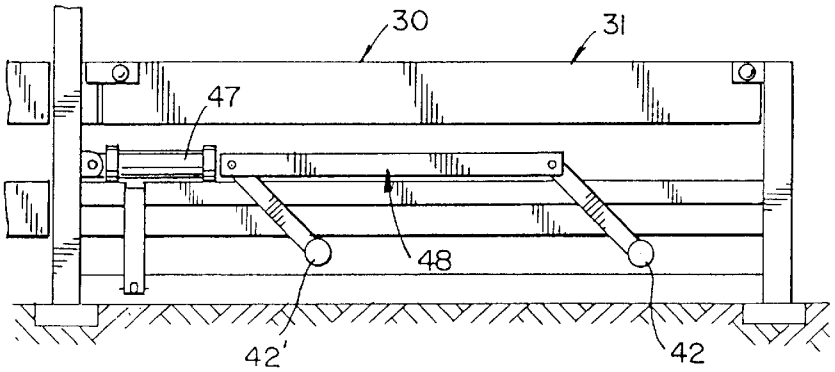
FIG. 3A is a partial elevational side view of the entrance mechanism for moving the platform assembly that supports a vehicle.
Figure 4B:
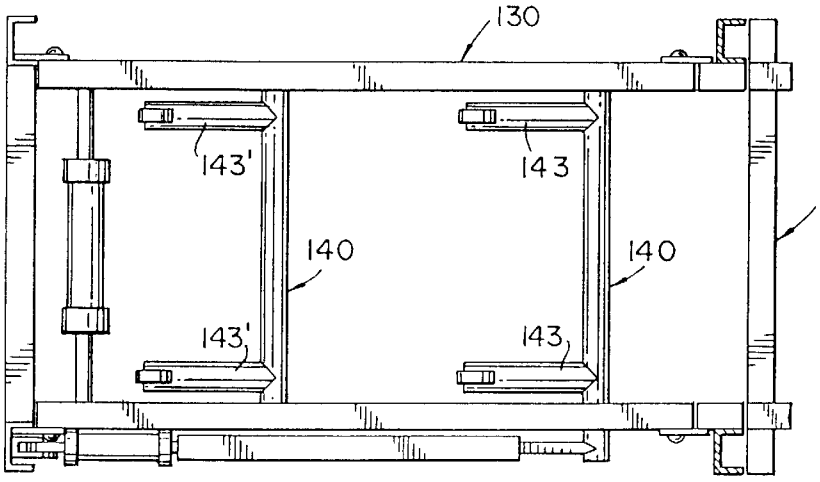
FIG. 4B is a top view of the mechanism shown in FIG. 3B illustrating the vehicle supporting assembly.
Figure 3B:
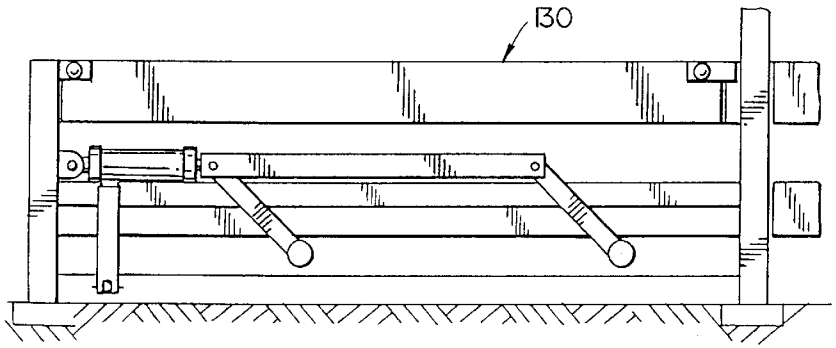
FIG. 3B is a partial elevational side view of the exit mechanism for moving the platform assembly that supports a vehicle.

After assembly 20 is loaded on assembly 30, hydraulic piston cylinder 35 of supporting assembly 30 is activated and arms 36 and 36' actuate guiding assemblies 31 and 31', respectively. Then, guiding assemblies 31 and 31' are released and projected outwardly thereby permitting unloaded platform assembly 20' to be lifted to upper level 37 by supporting assembly 40, as best seen in FIG. 6. FIGS. 3A; 3B; 4A and 4B illustrate supporting assembly 40 that makes possible this mechanism. Supporting assembly 40, in the preferred embodiment, is designed to lift unloaded platform assembly 20' to upper level 37 after platform assembly 20 with incoming vehicle V was delivered to assembly 60 mounted on lifting mechanism 50. Supporting assembly 40 includes elongated members 42 and 42' with arms 43 and 43' that are rigidly mounted thereto. Arms 43 and 43' end with supporting roller members 46 and 46, respectively, and are intended to support lower surface 23 of platform 20 while letting lift arms 43 and 43' through their rotation. Supporting assembly 40, as shown in FIGS. 3A and 4A, is hydraulically activated by piston cylinder 47 that is connected to elongated members 42 and 42' through linkage arm assembly 48.

Lateral traction assembly 180, that is located in carrier assembly 60, is a mechanism that permits carrier assembly 60 to move laterally once lifting mechanism 50 reaches a desired level for storing vehicle V. Lateral traction assembly 180 includes frame 181 with rollers 182 that permit assembly 180 to slide along guiding rails 183 actuated by motor member 184. When motor member 184 is activated, shaft 185 rotates sprockets 186 and 186' that in turn rotate traction sprocket members 192 and 192', as illustrated in FIG. 8. Traction sprocket members 189 and 189' are mounted to rods 187 and 187', respectively, which in turn are driven by sprocket chain assemblies 188 and 188'. Traction sprocket members 189 and 189' cooperatively engage with tracks 190 and 191. In this manner, carrier assembly 60 carrying platform 20 with a vehicle V on is laterally displaced to an available space S.

Figure 10:
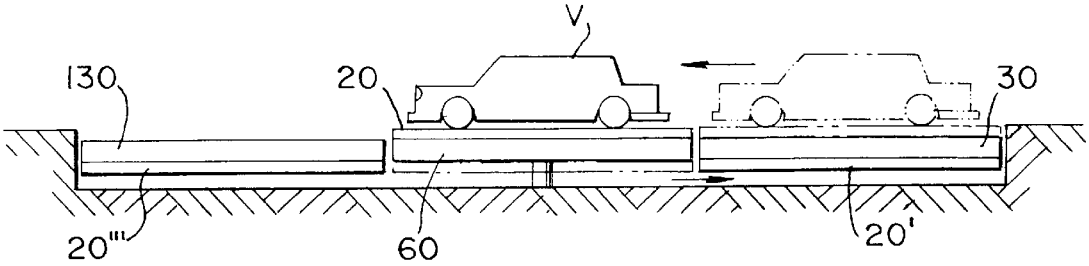
FIG. 10 is a representation of the second step in the use of the present invention, wherein the entrance moving platform assembly is transported to the lifting carrier assembly.

In FIGS. 9 through 13, the sequence of accepting and discharging a vehicle is illustrated. In FIG. 9, vehicle V is positioned on platform member 20. Carrier assembly 60, in the preferred embodiment, is mounted on a shaft of a lifting mechanism. Assembly 60 is brought horizontally next to member 20 to permit sprocket members 89 and 89' (shown in FIG. 8) to engage rack members 24 and 27 (shown in FIG. 5) thus pulling member 20 (and vehicle V) on top of assembly 60 while platform member 20' goes to entrance area, as seen in FIG. 10.

Figure 11:
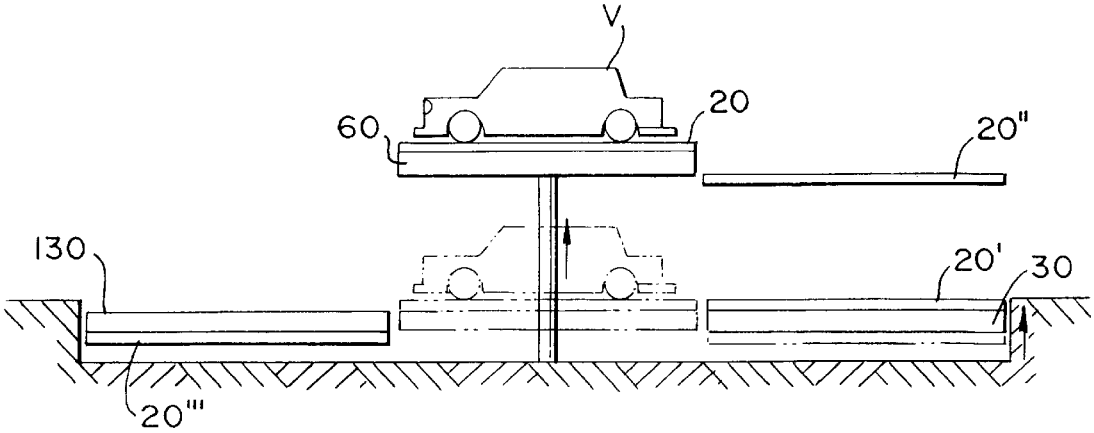
FIG. 11 is a representation of the third step in the use of the present invention, wherein a vehicle is lifted to a level where a parking space is available.
Figure 12:
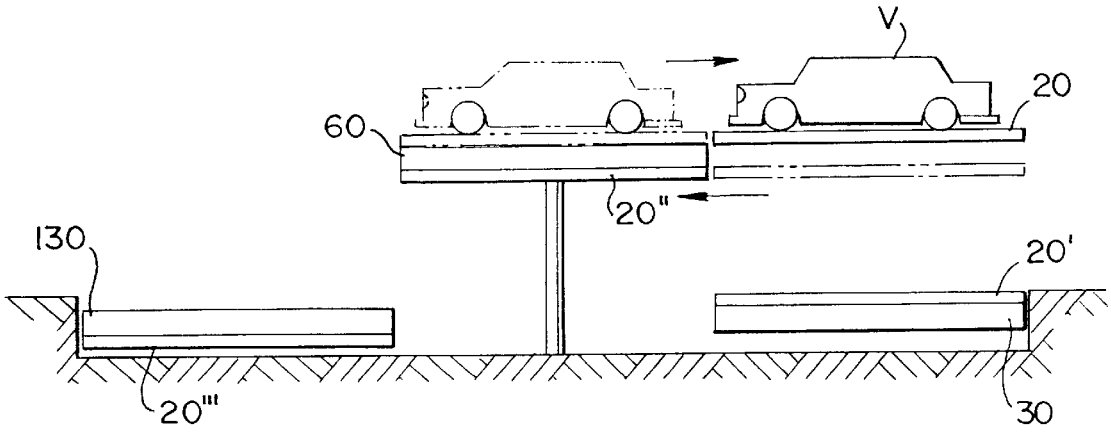
FIG. 12 is a representation of the fourth step in the use of the present invention, wherein the vehicle in the previous figure is carried to an empty parking space.

Next, as seen in FIG. 11, assembly 60 is lifted by lifting mechanism 50 and brought to a desired level. Again, assembly 60 is moved (hydraulically or otherwise) slightly to engage platform member 20' while depositing 20 in the storage compartment, as seen in FIG. 12.

Finally, the reverse operation brings vehicle V out of storage and once on the ground floor, member 20 is placed on the exit area on vehicle supporting assembly 130, as seen in FIG. 13, and the driver gets in vehicle V and drives it away. Once, platform assembly 20 is unloaded, exit vehicle supporting assembly 130 is activated similarly to assembly 30 when the former was delivered to lifting mechanism 50. As described above, supporting assembly 140 is hydraulically actuated by piston cylinder 148 and arms 143 and 143', that support now unloaded platform 20. Arms 143 and 143' are released thereby placing platform 20 in the lower level of supporting assembly 130. But, before this operation moving platform assembly 20''' is delivered from the lower lever of supporting assembly 130 by longitudinal traction assembly 80 of carrier assembly 60, in the same way is was done to receive entrance vehicle platform assembly 20 with vehicle V on. In this manner, moving platform assembly 20''' is converted into platform assembly 20' that will waiting in lower level 66 of assembly 60 to be delivered to lower level 38 of assembly 30 in the entrance area.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An apparatus for storing vehicles, comprising:

A) at least two platform assemblies to support one of said vehicles, each said platform assembly including a roller assembly;

B) a structure having a plurality of spaces of sufficiently large dimensions to house said vehicles and each of said spaces having an entrance and wherein each one of said spaces includes upper and lower guiding means for receiving and supporting one of said platform assemblies and each one of said spaces having one of said platform assemblies removably housed within said lower guiding means;

C) first and second support assemblies for cooperatively supporting one of said platform assemblies horizontally when said vehicles enter and exit, respectively said apparatus, and said first and second support assemblies including first means for slidably supporting said platform assemblies at upper and lower levels in spaced apart and parallel relationship to each other and further including means for raising and lowering said platform assemblies between said two levels;

D) carrier means for cooperatively receiving and delivering said platform assemblies from and to said first and second support assemblies and spaces, said carrier means further including second means for slidably supporting said platform assemblies at upper and lower levels in spaced apart and parallel relationship to each other so that one of said platform assemblies supported in said upper level is selectively and simultaneously exchanged with one of said platform assemblies supported by one of the lower guiding means of one of said spaces;

E) a traction assembly mounted to said carrier means including traction means for engaging and moving said platform assemblies in and out of said carrier means; and F) means for moving said carrier means to bring one of said platform assemblies in cooperative alignment with one of said entrances so that said traction means, when activated, moves said one platform assembly within the corresponding space to said one entrance.

2. The apparatus set forth in claim 1 wherein said means for moving said carrier means includes means for moving horizontally and perpendicularly with respect to the longitudinal direction of movement of said vehicles.

3. The apparatus set forth in claim 2 wherein said structure includes more than one of said spaces stacked on each other and said means for moving said carrier means includes means for moving said carrier means vertically to each one of said stacked spaces.

4. The apparatus set forth in claim 3 wherein said traction means includes a motorized sprocket assembly and cooperating mating toothed rack assemblies on said upper and lower platform assemblies in meshed engagement with said motorized sprocket assembly so that when said sprocket assembly is actuated one of said platform assemblies on said upper level of said carrier means moves longitudinally in one direction and another of said platform assemblies in said lower level of said carrier means moves simultaneously in the opposite direction.

5. The apparatus set forth in claim 4 wherein said traction means includes hydraulic means for urging said carrier means toward said platform assemblies to accomplish said meshed engagement.

* * * * *